US010203628B1

(12) United States Patent
Williamson

(10) Patent No.: US 10,203,628 B1
(45) Date of Patent: Feb. 12, 2019

(54) TONER AGITATOR ASSEMBLY

(71) Applicant: LEXMARK INTERNATIONAL, INC., Lexington, KY (US)

(72) Inventor: Randal Scott Williamson, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/722,084

(22) Filed: Oct. 2, 2017

(51) Int. Cl.
*G03G 15/08* (2006.01)

(52) U.S. Cl.
CPC ..... *G03G 15/0808* (2013.01); *G03G 15/0891* (2013.01); *G03G 15/0896* (2013.01); *G03G 15/0865* (2013.01); *G03G 2215/0819* (2013.01)

(58) Field of Classification Search
CPC ..... G03G 15/0808; G03G 15/0865; G03G 15/0889; G03G 15/0891; G03G 15/0896; G03G 2215/0819; G03G 2215/085
See application file for complete search history.

(56) References Cited

U.S. PATENT DOCUMENTS

| | | | | |
|---|---|---|---|---|
| 5,655,195 | A | 8/1997 | Ichikawa et al. | |
| 5,835,827 | A | 11/1998 | Kishimoto | |
| 6,418,290 | B1 | 7/2002 | Isomura et al. | |
| 6,456,810 | B1 | 9/2002 | Deguchi et al. | |
| 6,459,876 | B1 | 10/2002 | Buchanan et al. | |
| 6,470,163 | B1 | 10/2002 | Minagawa | |
| 6,496,662 | B1 | 12/2002 | Buchanan et al. | |
| 7,433,632 | B2 | 10/2008 | Askren et al. | |
| 7,532,843 | B2 | 5/2009 | Kern et al. | |
| 8,059,993 | B2 | 11/2011 | Gayne et al. | |
| 8,660,469 | B2 | 2/2014 | Carter, II et al. | |
| 8,688,016 | B2 | 4/2014 | Carter, II et al. | |
| 9,164,427 | B2 * | 10/2015 | Kobayashi | G03G 15/0877 |
| 9,360,796 | B2 | 6/2016 | Leemhuis | |
| 2006/0222414 | A1 | 10/2006 | Yamamura | |
| 2007/0280739 | A1 | 12/2007 | Tanaka | |
| 2008/0095553 | A1 | 4/2008 | Tanaka et al. | |
| 2008/0226351 | A1 | 9/2008 | Dawson et al. | |
| 2009/0087222 | A1 | 4/2009 | Mase et al. | |
| 2009/0087226 | A1 | 4/2009 | Yamazaki et al. | |
| 2009/0274491 | A1 | 11/2009 | Sato | |
| 2011/0008076 | A1 | 1/2011 | Kuroyama | |
| 2013/0170875 | A1 | 7/2013 | Sproul et al. | |
| 2016/0266515 | A1 * | 9/2016 | Maruyama | G03G 15/0889 |

FOREIGN PATENT DOCUMENTS

| | | | |
|---|---|---|---|
| EP | 1881376 | A1 | 1/2008 |

* cited by examiner

*Primary Examiner* — Sophia S Chen
(74) *Attorney, Agent, or Firm* — Justin M. Tromp

(57) ABSTRACT

A toner agitator assembly according to one example embodiment includes a shaft rotatable about a rotational axis. A wiper extends outward from the shaft and is rotatable with the shaft. The wiper is composed of a flexible film material. The wiper includes at least two fingers formed in a distal end of the wiper relative to the shaft. The fingers are individually deflectable counter to an operative rotational direction of the shaft.

17 Claims, 11 Drawing Sheets

TONER AGITATOR ASSEMBLY

CROSS REFERENCES TO RELATED APPLICATIONS

None.

BACKGROUND

1. Field of the Disclosure

The present disclosure relates generally to image forming devices and more particularly to a toner agitator assembly for an electrophotographic image forming device.

2. Description of the Related Art

In electrophotographic image forming devices, one or more replaceable units may be used to supply toner for printing onto sheets of media. For example, a toner cartridge may supply toner stored in a reservoir within the toner cartridge through an outlet on the toner cartridge to a corresponding inlet in the image forming device. Toner cartridges often include one or more toner agitators positioned within the toner reservoir that agitate and mix the toner to prevent the toner from clumping and that move the toner to the outlet. Internal geometries of the toner reservoir often make it difficult for the toner agitators to clean toner from all of the wall surfaces that form the toner reservoir causing some of the toner to be unusable because it cannot be moved to the outlet. Unused toner remains in the toner reservoir when the toner cartridge is removed from the image forming device and replaced with a new toner cartridge typically resulting in the waste of this residual toner. Accordingly, a simple, cost-effective method to reduce the amount of residual toner remaining in a toner supply reservoir is desired.

SUMMARY

A toner agitator assembly according to one example embodiment includes a shaft rotatable about a rotational axis. A wiper extends outward from the shaft and is rotatable with the shaft. The wiper is composed of a flexible film material. The wiper includes a first finger, a second finger and a third finger formed in a distal end of the wiper relative to the shaft. The first, second and third fingers are individually deflectable counter to an operative rotational direction of the shaft. The wiper is symmetrical along a radial centerline of the wiper.

A toner agitator assembly according to another example embodiment includes a shaft rotatable about a rotational axis. A wiper extends outward from the shaft and is rotatable with the shaft. The wiper is composed of a flexible film material. The wiper includes a first finger, a second finger and a third finger formed in a distal end of the wiper relative to the shaft and extending orthogonal to the rotational axis of the shaft. The first, second and third fingers are individually deflectable counter to an operative rotational direction of the shaft. The first, second and third fingers each have the same width in a direction along the rotational axis of the shaft. The second finger is positioned between the first and third fingers. The second finger has a greater length than the first and third fingers. In some embodiments, the first and third fingers have the same length.

In some embodiments, the wiper includes a first slit through the film material separating the first and second fingers and a second slit through the film material separating the second and third fingers. The first and second slits extend from the distal end of the wiper toward a proximal end of the wiper relative to the shaft. In some embodiments, the first and second slits extend in straight lines orthogonal to the rotational axis of the shaft.

A toner container according to one example embodiment includes a housing having a reservoir for storing toner and adjoining first and second tapered walls positioned within the reservoir. The first tapered wall angles toward a first side of the housing as the first tapered wall extends downward toward a bottom of the housing. The second tapered wall angles toward a second side of the housing as the second tapered wall extends downward toward the bottom of the housing. A rotatable shaft is positioned within the reservoir and is rotatable about a rotational axis. A wiper extends outward from the rotatable shaft and is rotatable with the rotatable shaft. The wiper is composed of a flexible film material. The wiper includes a first finger and a second finger formed in a distal end of the wiper relative to the rotatable shaft. The first and second fingers are individually deflectable counter to an operative rotational direction of the rotatable shaft. The first finger is positioned to contact the first tapered wall upon rotation of the rotatable shaft in the operative rotational direction and to deflect counter to the operative rotational direction of the rotatable shaft by the contact with the first tapered wall and the second finger is positioned to contact the second tapered wall upon rotation of the rotatable shaft in the operative rotational direction and to deflect counter to the operative rotational direction of the rotatable shaft by the contact with the second tapered wall.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
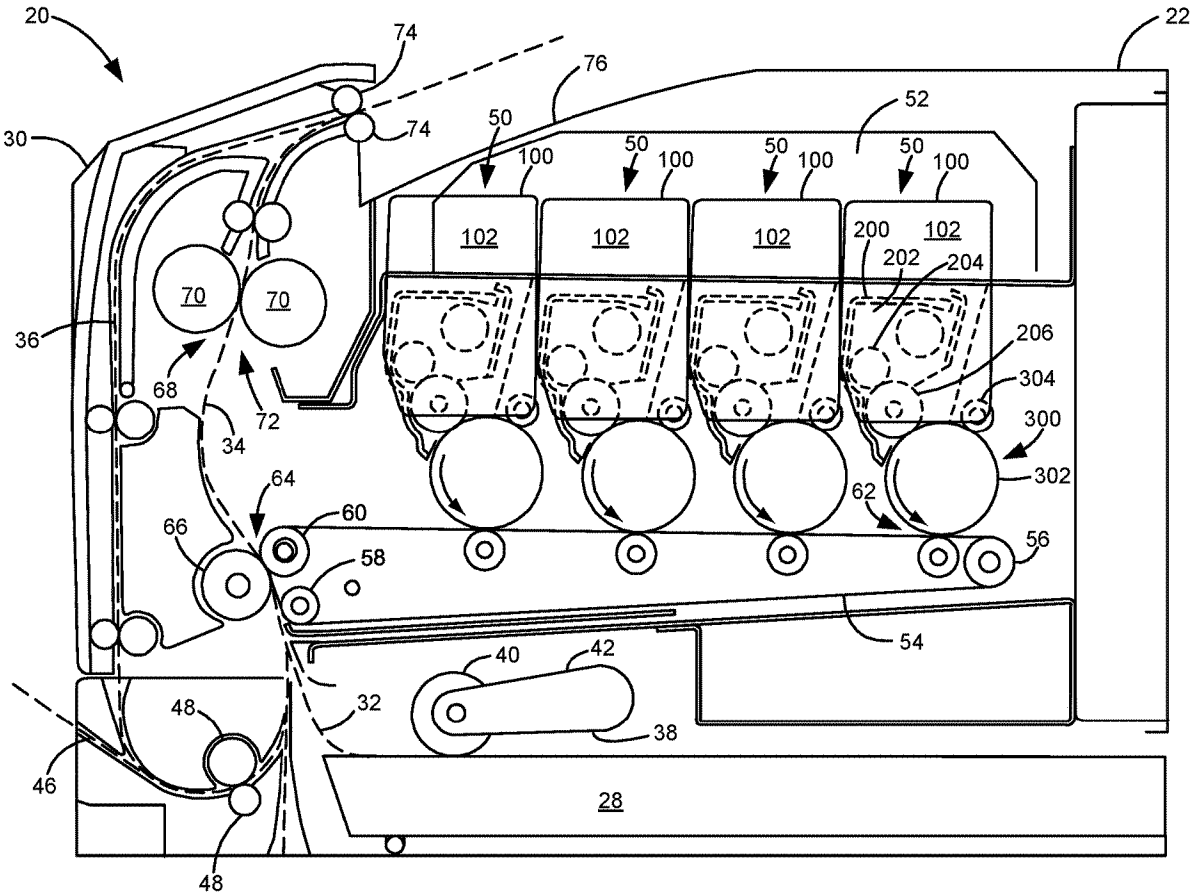
FIG. 1 is a schematic view of an image forming device according to one example embodiment.

FIG. 1 illustrates a schematic view of the interior of an example image forming device 20. Image forming device 20 includes a housing 22. Housing 22 includes one or more input trays 28 positioned therein. Trays 28 are sized to contain a stack of media sheets. As used herein, the term media is meant to encompass not only paper but also labels, envelopes, fabrics, photographic paper or any other desired substrate. Trays 28 are preferably removable for refilling. A control panel 30 may be located on housing 22. Using control panel 30, the user is able to enter commands and generally control the operation of the image forming device 20. For example, the user may enter commands to switch modes (e.g., color mode, monochrome mode), view the number of images printed, etc. A media path 32 extends through image forming device 20 for moving the media sheets through the image transfer process. Media path 32 includes a simplex path 34 and may include a duplex path 36. A media sheet is introduced into simplex path 34 from tray 28 by a pick mechanism 38. In the example embodiment shown, pick mechanism 38 includes a roll 40 positioned at the end of a pivotable arm 42. Roll 40 rotates to move the media sheet from tray 28 and into media path 32. The media sheet is then moved along media path 32 by various transport rollers. Media sheets may also be introduced into media path 32 by a manual feed 46 having one or more rolls 48.

Image forming device 20 includes an image transfer section that includes one or more imaging stations 50. Each imaging station 50 includes a toner cartridge 100 and a developer unit 200 mounted on a common photoconductive unit (PC unit) 300. Each toner cartridge 100 includes a reservoir 102 for holding toner and an outlet port in communication with an inlet port of a corresponding developer unit 200 for transferring toner from reservoir 102 to developer unit 200 as discussed in greater detail below. In the example embodiment illustrated, developer unit 200 utilizes what is commonly referred to as a single component development system. In this embodiment, each developer unit 200 includes a toner reservoir 202 and a toner adder roll 204 that moves toner from reservoir 202 to a developer roll 206. In another embodiment, developer unit 200 utilizes what is commonly referred to as a dual component development system. In this embodiment, toner in toner reservoir 202 is mixed with magnetic carrier beads. The magnetic carrier beads may be coated with a polymeric film to provide triboelectric properties to attract toner to the carrier beads as the toner and the magnetic carrier beads are mixed in the toner sump. In this embodiment, developer roll 206 attracts the magnetic carrier beads having toner thereon to developer roll 206 through the use of magnetic fields. The PC unit 300 includes a charging roll 304 and a photoconductive (PC) drum 302 for each imaging station 50. PC drums 302 are mounted substantially parallel to each other. For purposes of clarity, developer unit 200, PC drum 302 and charging roll 304 are labeled on only one of the imaging stations 50. In the example embodiment illustrated, each imaging station 50 is substantially the same except for the color of toner.

Each charging roll 304 forms a nip with the corresponding PC drum 302. During a print operation, charging roll 304 charges the surface of PC drum 302 to a specified voltage. A laser beam from a printhead 52 associated with each imaging station 50 is then directed to the surface of PC drum 302 and selectively discharges those areas it contacts to form a latent image. Developer roll 206 then transfers toner to PC drum 302 to form a toner image. A metering device, such as a doctor blade, may be used to meter toner onto developer roll 206 and apply a desired charge on the toner prior to its transfer to PC drum 302. The toner is attracted to the areas of PC drum 302 surface discharged by the laser beam from the printhead 52.

In the example embodiment illustrated, an intermediate transfer mechanism (ITM) 54 is disposed adjacent to the imaging stations 50. In this embodiment, ITM 54 is formed as an endless belt trained about a drive roll 56, a tension roll 58 and a back-up roll 60. During image forming operations, ITM 54 moves past imaging stations 50 in a clockwise direction as viewed in FIG. 1. One or more of PC drums 302 apply toner images in their respective colors to ITM 54 at a first transfer nip 62. In one embodiment, a positive voltage field attracts the toner image from PC drums 302 to the surface of the moving ITM 54. ITM 54 rotates and collects the one or more toner images from imaging stations 50 and then conveys the toner images to a media sheet advancing through simplex path 34 at a second transfer nip 64 formed between a transfer roll 66 and ITM 54, which is supported by back-up roll 60. In other embodiments, the toner image is transferred to the media sheet directly by the PC drum(s) 302.

The media sheet with the toner image is then moved along the media path 32 and into a fuser area 68. Fuser area 68 includes fusing rolls or belts 70 that form a nip 72 to adhere the toner image to the media sheet. The fused media sheet then passes through exit rolls 74 that are located downstream from the fuser area 68. Exit rolls 74 may be rotated in either forward or reverse directions. In a forward direction, the exit rolls 74 move the media sheet from simplex path 34 to an output area 76 of image forming device 20. In a reverse direction, exit rolls 74 move the media sheet into duplex path 36 for image formation on a second side of the media sheet.

Figure 2:
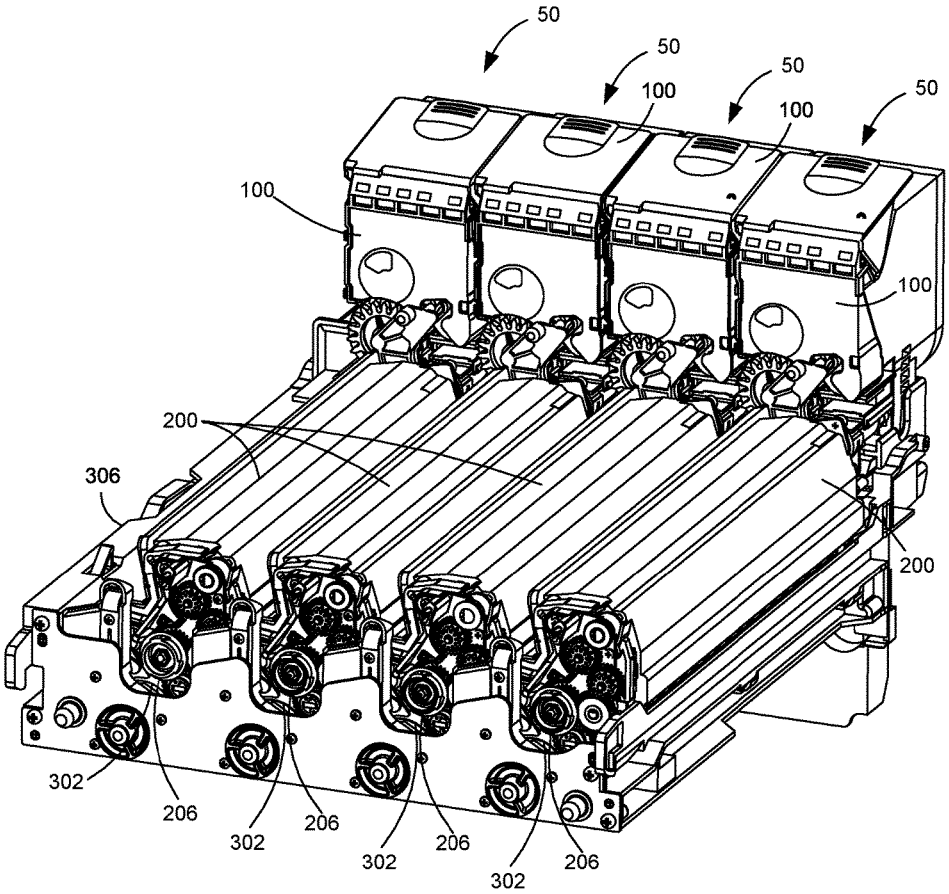
FIG. 2 is a perspective view of four imaging stations each having a toner cartridge and a developer unit for use with the image forming device according to one example embodiment.

A monocolor image forming device 20 may include a single imaging station 50, as compared to a color image forming device 20 that may include multiple imaging stations 50. FIG. 2 illustrates a set of four imaging stations 50 that each includes a respective toner cartridge 100, developer unit 200 and PC drum 302 mounted in a frame 306 of PC unit 300. Frame 306 includes a central opening sized to receive developer units 200 and to mate developer rolls 206 with their respective PC drums 302.

Figure 3:
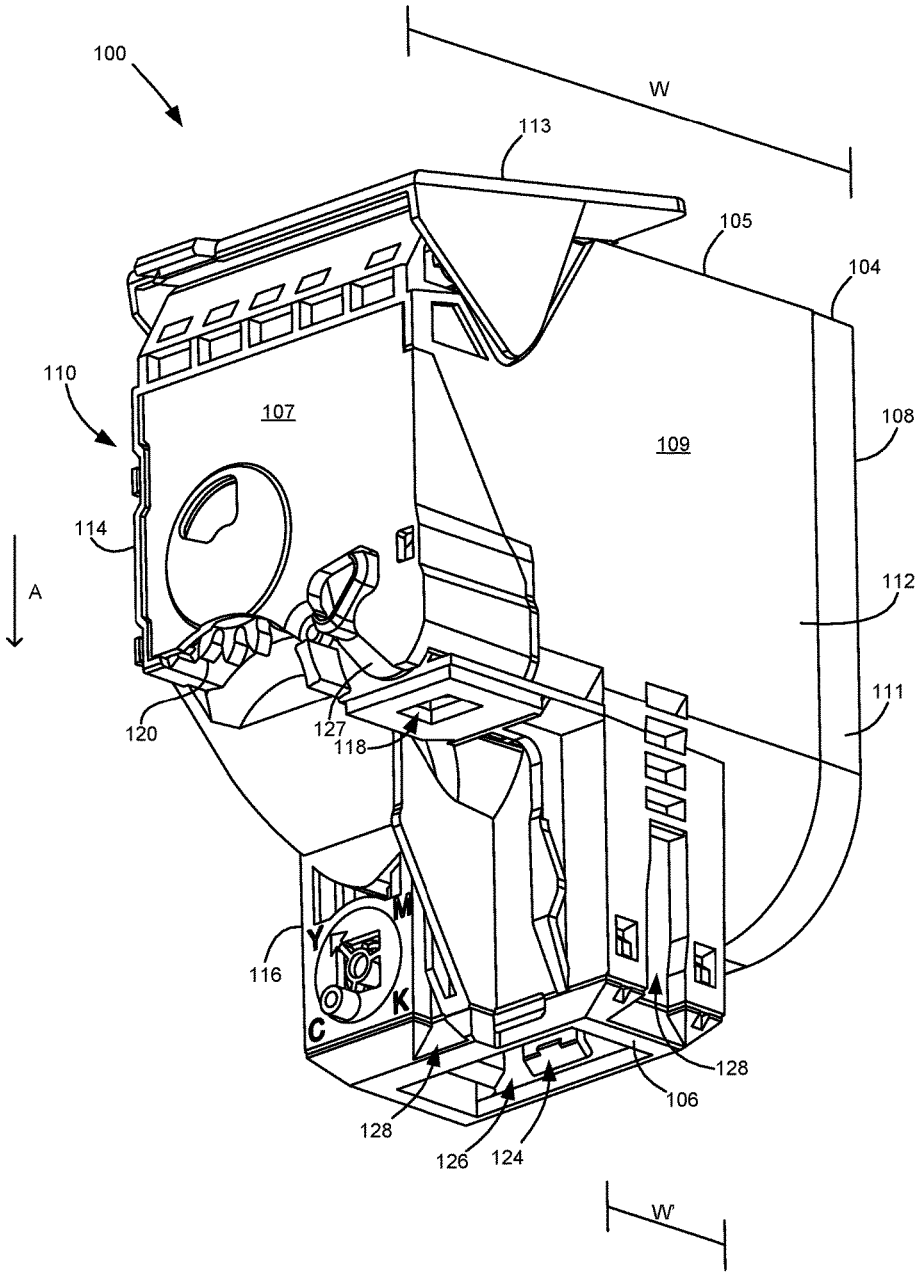
FIG. 3 is a front perspective view of the toner cartridge according to one example embodiment.

FIG. 3 shows toner cartridge 100 according to one example embodiment. Toner cartridge 100 includes a housing 104 having a top 105, a bottom 106, a front 107, a rear 108 and a pair of sides 109, 110 and forming reservoir 102 therein. In one embodiment, housing 104 is comprised of an end cap 111 mounted on, such as by ultrasonic welding, a main body 112 at the rear 108 of cartridge 100. A handle 113 may be positioned on top 105 to facilitate grasping and manipulating cartridge 100 during insertion and removal from image forming device 20. In the example embodiment illustrated, housing 104 includes a main section 114 and an extension section 116. Extension section 116 is positioned at the bottom 106 of housing 104. As illustrated in FIG. 3, a depth W' of extension section 116 measured between the front 107 and rear 108 is smaller than a depth W of main section 114. Toner cartridge 100 includes an overall height measured between the top 105 and the bottom 106. In one embodiment, extension section 116 includes a smaller height than main section 114.

Toner cartridge 100 includes an outlet port 118 for transferring toner to an inlet port of developer unit 200. Outlet port 118 is formed as a downward facing opening on main section 114 on the front 107 of housing 104. Outlet port 118 includes a shutter 127 positioned therein that regulates whether toner is permitted to flow from reservoir 102 out of outlet port 118. Shutter 127 may be rotatable between a closed position that prevents toner from exiting outlet port 118 and an open position that permits toner to flow out of outlet port 118. Shutter 127 is biased toward the closed position by an over-center spring (not shown) to prevent toner from escaping unless toner cartridge 100 is installed within image forming device 22. Shutter 127 includes a cylindrical body having a hollow interior and an exit opening. In the closed position, the exit opening is positioned away from outlet port 118 to prevent toner movement. In the open position, the exit opening of shutter 127 is aligned with outlet port 118 to allow toner movement. In one embodiment, shutter 127 is of the type shown and described in U.S. Pat. No. 7,606,520 entitled "Shutter for a Toner Cartridge for use with an Image Forming Device," which is assigned to the assignee of the present application and incorporated herein by reference.

Figure 4:
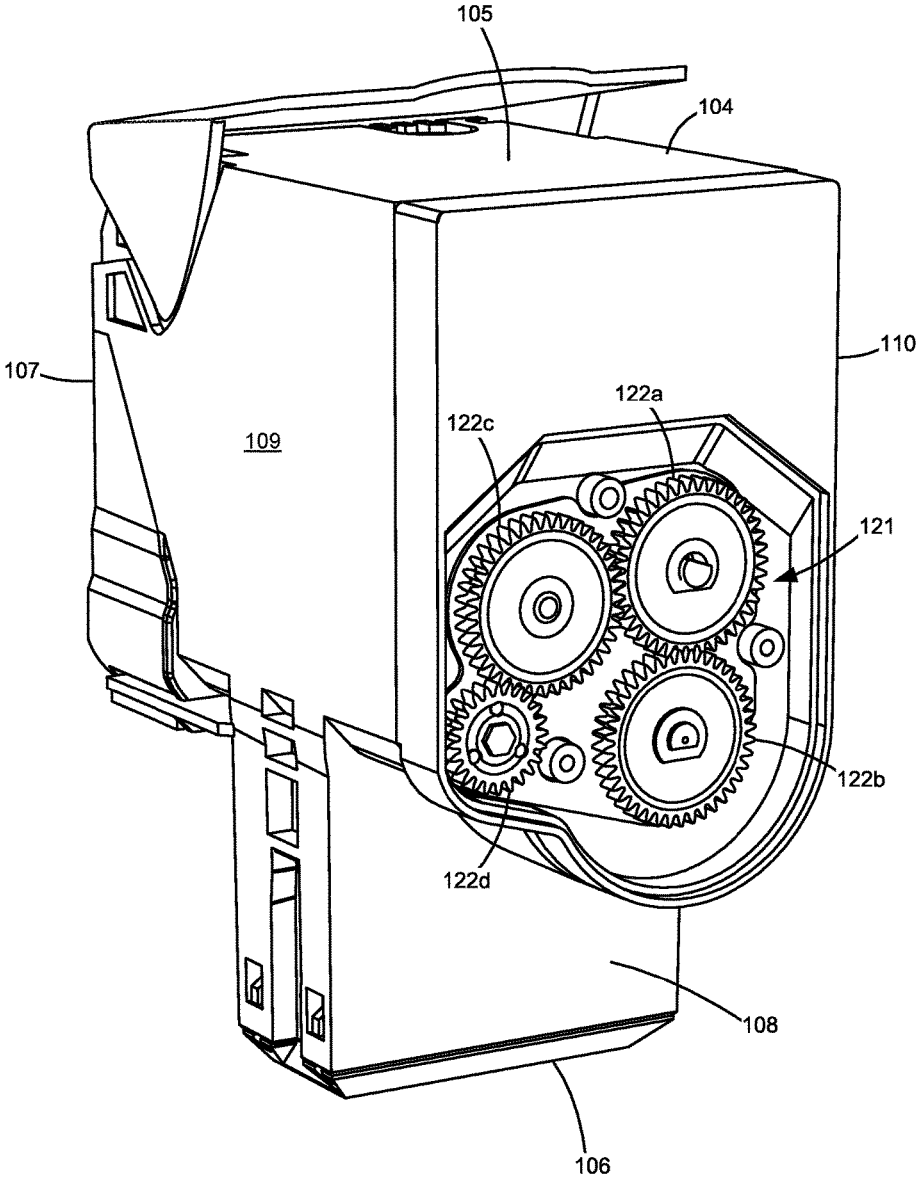
FIG. 4 is a rear perspective view of the toner cartridge shown in FIG. 3 with a portion of an end cap of the toner cartridge omitted to illustrate a drive train of the toner cartridge according to one example embodiment.

Toner cartridge 100 further includes a drive gear 120 positioned on the front 107 of housing 104. Drive gear 120 meshes with and receives rotational power from a corresponding gear in image forming device 20 in order to provide rotational power to various toner agitators positioned within reservoir 102 for moving toner to outlet port 118 as discussed in greater detail below. FIG. 4 shows toner cartridge 100 with a portion of end cap 111 omitted. In the example embodiment illustrated, drive gear 120 is rotatably connected to a drive train 121 that is positioned between end cap 111 and rear 108 of main body 112. Drive train 121 aids in transferring rotational power from drive gear 120 to the toner agitators positioned within reservoir 102.

With reference back to FIG. 3, toner cartridge 100 may also include an electrical connector 124 having processing circuitry for communicating with a controller of image forming device 20. The processing circuitry may provide authentication functions, safety and operational interlocks, operating parameters and usage information related to toner cartridge 100. In the example embodiment illustrated, electrical connector 124 is positioned in a recess 126 in the bottom 106 of housing 104. When toner cartridge 100 is installed in image forming device 20, contacts on electrical connector 124 mate with corresponding contacts to establish a communication link to the controller of image forming device 20. In one embodiment, electrical connector 124 is of the type shown and described in U.S. Pat. No. 7,272,336 entitled "Cartridge with a Movable Electrical Connector," which is assigned to the assignee of the present application and incorporated herein by reference.

Toner cartridge 100 may also include various alignment members 128 that align toner cartridge 100 with developer unit 200 during insertion of toner cartridge 100 in the direction shown by arrow A in FIG. 3. For example, alignment members 128 may include a combination of projections that project outwardly from sides 109, 110 of housing 104 and/or elongated slots formed as depressions in sides 109, 110 that mate with corresponding slots and/or projections, respectively, to ensure accurate positioning of toner cartridge 100. For example, alignment members 128 help ensure that outlet port 118 mates with the inlet port of developer unit 200, that drive gear 120 mates with the corresponding drive gear in image forming device 20 and that electrical connector 124 mates with corresponding electrical contacts.

Figure 5:
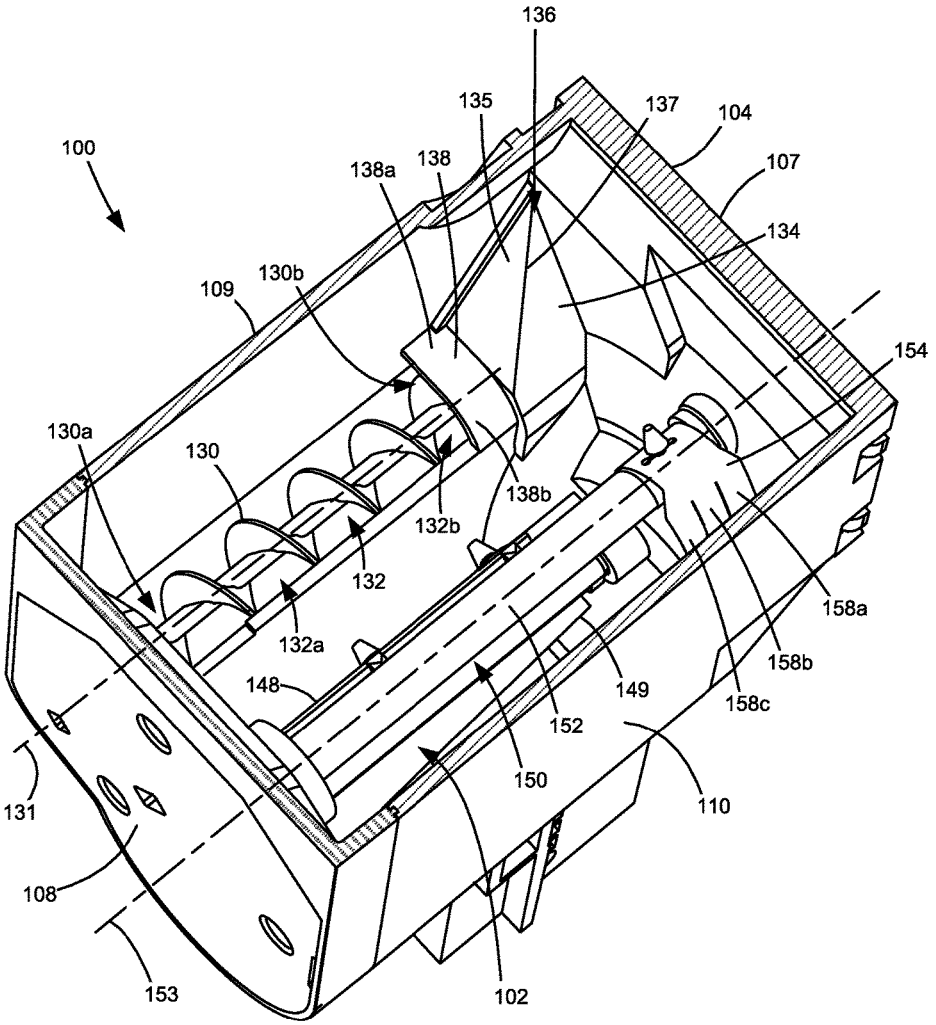
FIGS. 5 and 6 are first and second cross-sectional views of the toner cartridge shown in FIGS. 3 and 4 showing a toner reservoir of the toner cartridge according to one example embodiment.
Figure 6:
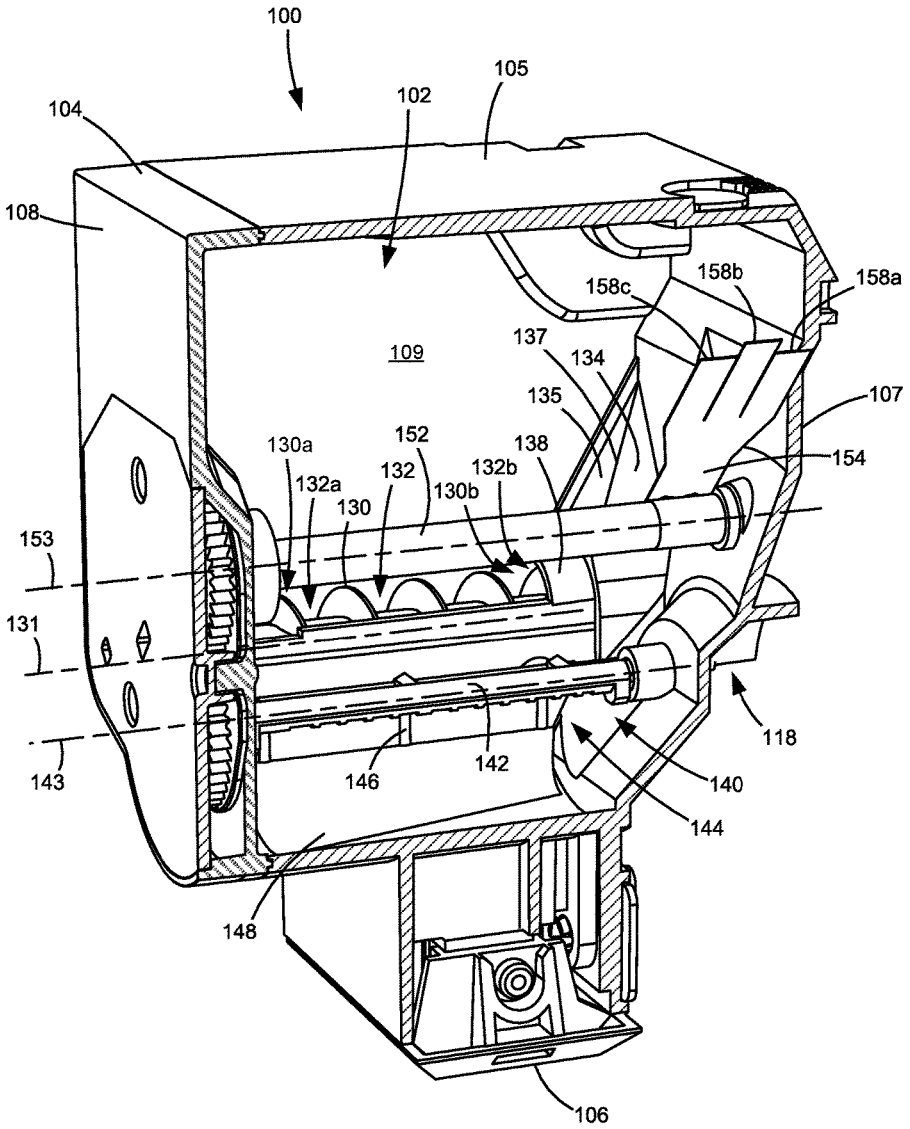

FIGS. 5 and 6 are cross-sectional views of toner cartridge 100 illustrating toner reservoir 102 according to one example embodiment. In the example embodiment illustrated, an auger 130 having first and second ends 130*a*, 130*b* and a spiral screw flight is positioned in a channel 132 that runs along side 109 of housing 104 from front 107 to rear 108. Channel 132 may be integrally molded as part of side 109 of main body 112 or formed as a separate component that is attached to side 109 of main body 112. Channel 132 is oriented generally horizontal when toner cartridge 100 is installed in image forming device 20. Auger 130 includes a rotational axis 131. Rotation of auger 130 delivers toner in channel 132 to outlet port 118, which is positioned at the bottom of channel 132 so that gravity assists in exiting toner through outlet port 118. Channel 132 includes an open portion 132*a* and an enclosed portion 132*b*. Open portion 132*a* is open to toner reservoir 102 and extends from rear 108 toward second end 130*b* of auger 130. Enclosed portion 132*b* of channel 132 extends from front 107 and encloses second end 130*b* of auger 130. In this embodiment, outlet port 118 is positioned at the bottom of enclosed portion 132*b* of channel 132. In this configuration, closed portion 132*b* of channel 132 regulates the amount of toner delivered by auger 130 to outlet port 118 in order to provide a more consistent flow rate of toner from toner cartridge 100 to developer unit 200.

In the example embodiment illustrated, housing 104 includes a pair of tapered walls 134, 135 positioned within toner reservoir 102 at a corner 136 formed at the intersection of front 107 and side 109 of housing 104. Tapered walls 134, 135 are positioned directly above and lead downward to enclosed portion 132*b* of channel 132. In the embodiment illustrated, each tapered wall 134, 135 consists of a triangle-shaped, planar surface. In this embodiment, the triangle shapes of tapered walls 134, 135 share a common edge 137. Edge 137 begins at corner 136 of housing 104 and extends in a straight line downward toward bottom 106 and toward rear 108 and side 110. Tapered wall 134 angles toward side 110 as tapered wall 134 extends downward toward bottom 106. Tapered wall 135 angles toward rear 108 as tapered wall 135 extends downward toward bottom 106. Tapered walls 134, 135 aid in preventing toner from collecting above enclosed portion 132*b* of channel 132. Specifically, the angles of tapered walls 134, 135 encourage toner to slide downward along tapered walls 134, 135 toward a central portion of reservoir 102 where the toner can more easily be moved to open portion 132*a* of channel 132 and fed by auger 130. Although the example embodiment illustrated includes a pair of planar walls 134, 135 positioned in corner 136 of reservoir 102, it will be appreciated that tapered walls may be utilized in corner 136 according to many different shapes, such as, for example, one or more curved walls and/or planar walls of any suitable shape, in order to help prevent toner from collecting above enclosed portion 132*b* of channel 132.

In the example embodiment illustrated, housing 104 also includes a shelf 138 formed at the top of enclosed portion 132*b* of channel 132. Shelf 138 extends from a bottom portion of tapered wall 135 toward rear 108 of housing 104. In the example embodiment illustrated, shelf 138 includes a horizontal portion 138*a* that extends from side 109 over auger 130 and a curved portion 138*b* that curves downward from horizontal portion 138*a* toward side 110. Shelf 138 extends enclosed portion 132*b* of channel 132 toward rear 108 to ensure that enclosed portion 132*b* of channel 132 extends far enough from outlet port 118 relative to the pitch of auger 130 to regulate the toner delivered by auger 130 to outlet port 118.

A toner agitator assembly 140 is rotatably positioned within toner reservoir 102. Toner agitator assembly 140 includes a rotatable drive shaft 142 and one or more toner agitators 144 that extend outward from drive shaft 142. Drive shaft 142 includes a rotational axis 143 that is parallel to rotational axis 131 of auger 130. Drive shaft 142 is spaced toward side 110 from channel 132 at roughly the same height as auger 130 (e.g., slightly lower than auger 130 in the embodiment illustrated). As drive shaft 142 rotates, toner agitators 144 rotate around rotational axis 143 agitating and mixing the toner stored in reservoir 102 and pushing toner into open portion 132*a* of channel 132 to supply auger 130 with toner to deliver to outlet port 118. In the example embodiment illustrated, toner agitator 144 includes a paddle 146 that extends from drive shaft 142. Paddle 146 may be composed of, for example, a rigid plastic material, such as acrylonitrile butadiene styrene (ABS). In the example embodiment illustrated, toner agitator 144 also includes a wiper 148 mounted on paddle 146 that extends in a cantilevered manner away from a distal end of paddle 146. Wiper 148 is formed from a flexible film material such as a polyethylene terephthalate (PET) material, e.g., MYLAR® available from DuPont Teijin Films, Chester, Va., USA. In the example embodiment illustrated, a distal end 149 of wiper 148 forms an interference fit with interior surfaces of the bottom 106 of housing 104 in order to wipe toner from the bottom 106 of housing 104 as drive shaft 142 rotates and to flick toner into open portion 132*a* of channel 132 as distal end 149 of wiper 148 passes open portion 132*a* of channel 132.

Figure 7:
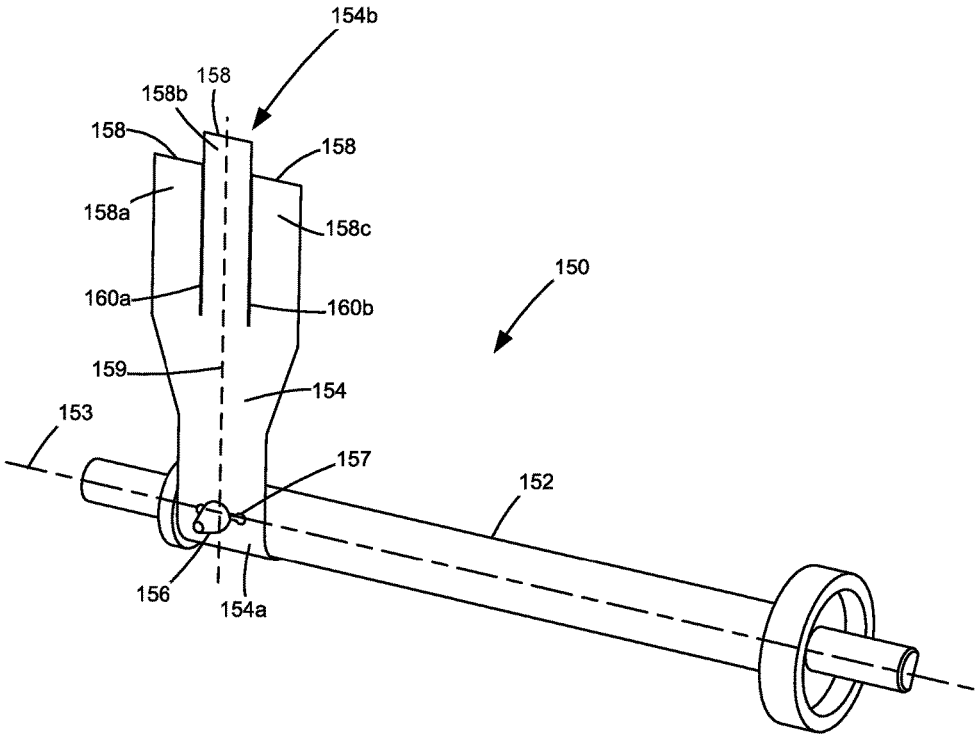
FIG. 7 is a perspective view of a toner agitator of the toner cartridge according to one example embodiment.

With reference to FIGS. 5-7, toner agitator assembly 140 also includes a toner agitator 150 that extends outward from a rotatable drive shaft 152 positioned within toner reservoir 102. Drive shaft 152 includes a rotational axis 153 that is parallel to rotational axis 131 of auger 130 and rotational axis 143 of drive shaft 142. Drive shaft 152 is positioned higher than auger 130 and drive shaft 142 and is spaced toward side 110 from channel 132. As drive shaft 152 rotates, toner agitator 150 rotates around rotational axis 153 of drive shaft 152. Toner agitator 150 includes a wiper 154 composed of a flexible film material such as a polyethylene terephthalate (PET) material, e.g., MYLAR® available from DuPont Teijin Films, Chester, Va., USA. Wiper 154 includes a proximal end 154*a* that is mounted to drive shaft 152 and a distal end 154*b* extending outward from drive shaft 152. In the example embodiment illustrated, proximal end 154*a* of wiper 154 is wrapped around drive shaft 152 and retained on drive shaft 152 by one or more mounting posts 156 that extend from drive shaft 152 into corresponding mounting holes 157 on wiper 154. However, wiper 154 may be attached to drive shaft 152 by any suitable method.

Wiper 154 includes two or more fingers 158 formed in distal end 154*b* of wiper 154 positioned to wipe toner from the interior surfaces of corner 136 of housing 104. For example, in the embodiment illustrated, wiper 154 includes three fingers 158*a*, 158*b*, 158*c* formed in distal end 154*b* of wiper 154. Fingers 158*a*, 158*b*, 158*c* are formed by a pair of slits 160*a*, 160*b* through the film material of wiper 154. In particular, slit 160*a* separates fingers 158*a* and 158*b* and slit 160*b* separates fingers 158*b* and 158*c*. Slits 160*a*, 160*b* extend from distal end 154*b* of wiper 154 toward proximal end 154*a* of wiper 154. Slits 160*a*, 160*b* permit fingers 158*a*, 158*b*, 158*c* to flex or deflect counter to the rotational direction of drive shaft 152 independent of each other. In this manner, each finger 158*a*, 158*b*, 158*c* is able to individually conform to a different geometry of housing 104 in reservoir 102. In the embodiment illustrated, slits 160*a*, 160*b* and fingers 158*a*, 158*b*, 158*c* extend in straight lines orthogonal to rotational axis 153 of drive shaft 152, but other orientations may be used as desired. In the example embodiment illustrated, finger 158*b* has a greater length than fingers 158*a* and 158*c*. In the embodiment illustrated, fingers 158*a* and 158*c* have the same length as each other. In the embodiment illustrated, each finger 158*a*, 158*b*, 158*c* has the same width in a direction along rotational axis 153 of drive shaft 152 such that wiper 154 is symmetrical along a radial centerline 159 of wiper 154. However, in other embodiments, fingers 158 may take other dimensions relative to each other as desired. As discussed in greater detail below, as drive shaft 152 rotates, finger 158*a* is positioned to wipe toner from the surface of tapered wall 134, finger 158*b* is positioned to wipe toner from the surface of tapered wall 135 and finger 158*c* is positioned to wipe toner from the surface of shelf 138.

In the example embodiment illustrated, a first end of drive shaft 152 is directly connected to drive gear 120 such that rotation of drive gear 120 causes toner agitator 150 to rotate. With reference to FIG. 4, a second end of drive shaft 152 is directly connected to a gear 122*a* of drive train 121 on rear 108 of housing 104. In this manner, drive shaft 152 serves as a transfer shaft to transfer rotational motion from drive gear 120 on front 107 of housing 104 to drive train 121 on rear 108 of housing 104. In the example embodiment illustrated, gear 122*a* is meshed with and provides rotational motion to a gear 122*b* that is directly connected to drive shaft 142 in order to rotate toner agitator 140. Gear 122*a* also provides rotational motion through an idler gear 122*c* to a gear 122*d* that is directly connected to auger 130 in order to rotate auger 130. Of course, it will be appreciated that rotational motion may be provided to drive shafts 142, 152 and auger 130 by any suitable connections.

Figure 8:
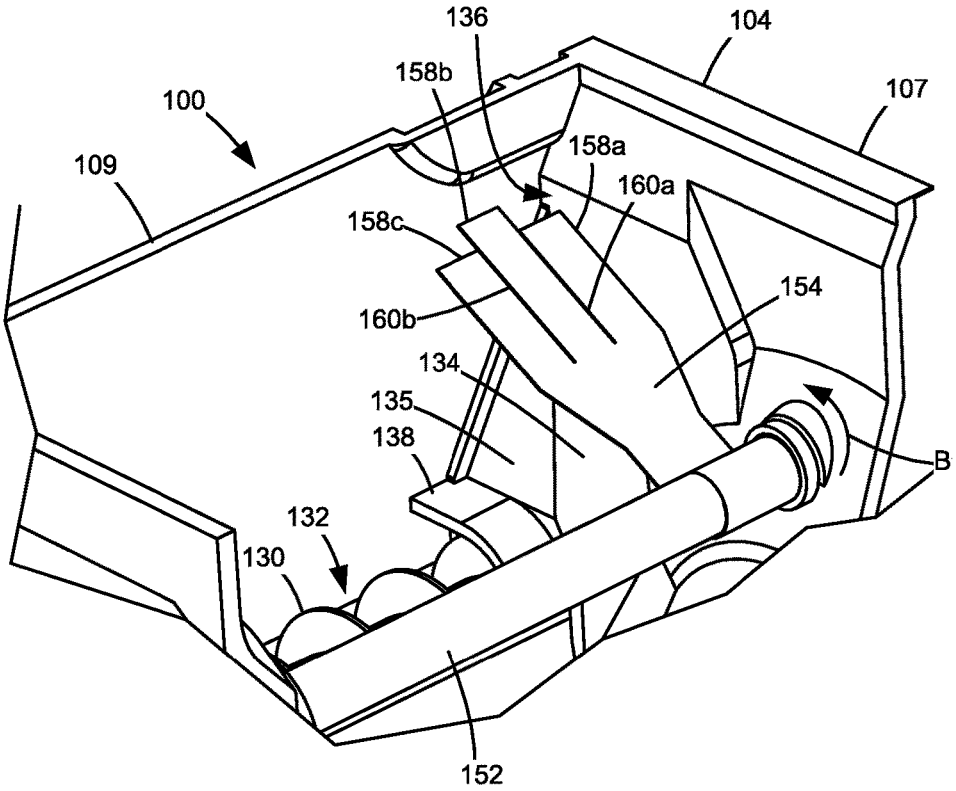
FIGS. 8-10 are sequential cross-sectional views of the toner cartridge illustrating the operation of the toner agitator according to one example embodiment.
Figure 9:
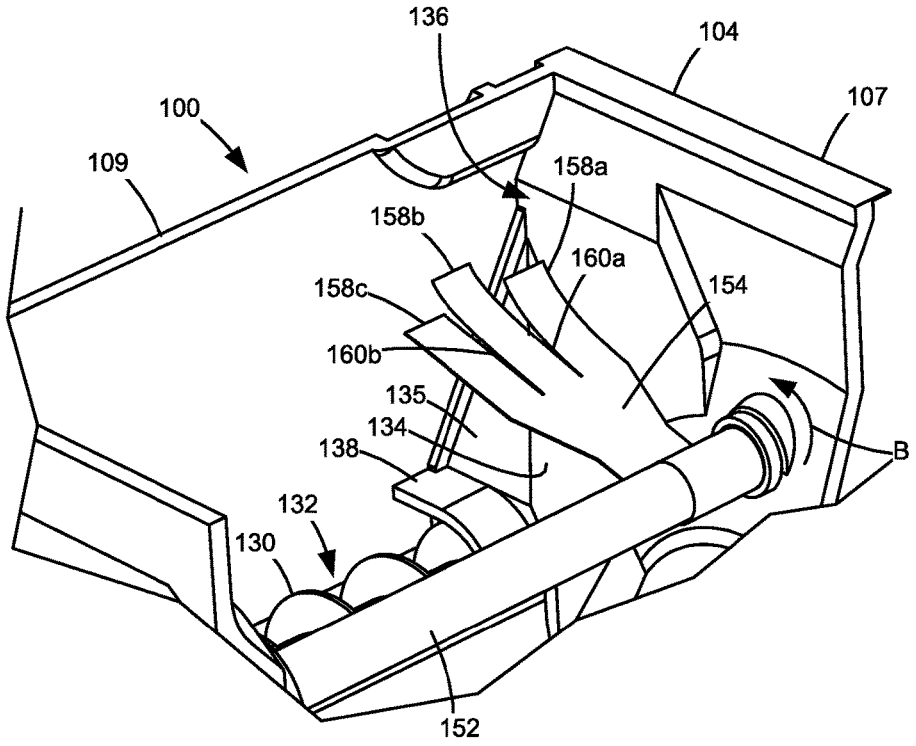
Figure 10:
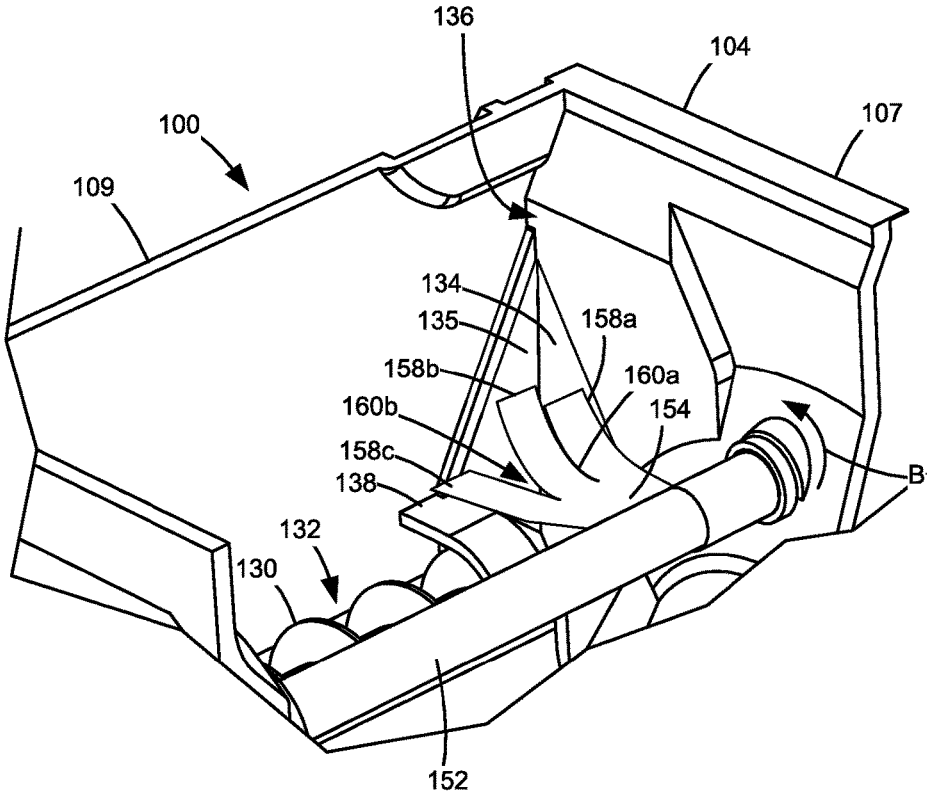

FIGS. 8-10 are sequential views illustrating the operation of toner agitator 150 according to one example embodiment. FIG. 8 shows wiper 154 approaching tapered walls 134, 135 at corner 136 of housing 104 as drive shaft 152 rotates in an operative rotational direction indicated by the arrow B. FIG. 9 shows drive shaft 152 rotated further in its operative rotational direction with finger 158*a* of wiper 154 in contact with tapered wall 134. Contact between tapered wall 134 and finger 158*a* of wiper 154 causes finger 158*a* to flex counter to the operative rotational direction of drive shaft 152 against tapered wall 134 as drive shaft 152 rotates. The flexing of finger 158*a* against tapered wall 134 allows finger 158*a* to wipe toner on tapered wall 134 downward into a central portion of reservoir 102. Finger 158*a* is able to flex independent of fingers 158*b* and 158*c* such that fingers 158*b* and 158*c* are free to remain in an extended position as finger 158*a* flexes against tapered wall 134. In the embodiment illustrated, finger 158*a* also contacts and helps clear toner from the interior surface of front 107 of housing 104 as drive shaft 152 rotates.

FIG. 10 shows drive shaft 152 rotated further in its operative rotational direction with finger 158*a* remaining in contact with tapered wall 134, finger 158*b* in contact with tapered wall 135 and finger 158*c* approaching shelf 138. Finger 158*a* is flexed further against tapered wall 134 and continues to wipe toner from tapered wall 134. Contact between tapered wall 135 and finger 158*b* of wiper 154 causes finger 158*b* to flex counter to the operative rotational direction of drive shaft 152 against tapered wall 135 as drive shaft 152 rotates. Similarly, contact between shelf 138 and finger 158*c* of wiper 154 causes finger 158*c* to flex counter to the operative rotational direction of drive shaft 152 against shelf 138 as drive shaft 152 rotates further. The flexing of fingers 158*b* and 158*c* allows fingers 158*b* and 158*c* to wipe toner on tapered wall 135 and shelf 138, respectively, downward into a central portion of reservoir 102 where the toner can more easily be moved to open portion 132*a* of channel 132 by wiper 148 and fed by auger 130. Slits 160*a* and 160*b* permit fingers 158*a*, 158*b*, 158*c* to flex independently of each other allowing fingers 158*a*, 158*b*, 158*c* to individually conform to and individually wipe toner from tapered walls 134, 135 and shelf 138, respectively, in order to reduce the amount of residual toner left on tapered walls 134, 135 and shelf 138.

In the example embodiment illustrated, the lengths of fingers 158*a* and 158*b* are selected to allow fingers 158*a* and 158*b* to reach the portions of tapered walls 134 and 135 closest to side 109 of housing 104 such that finger 158*b* is longer than finger 158*a*. Specifically, finger 158*a* is long enough to reach the top of tapered wall 134 and finger 158*b* is long enough to reach the interior surface of side 109. The length of finger 158*c* may be similarly selected to allow finger 158*c* to reach the portions of shelf 138 closest to side 109. However, in the example embodiment illustrated, finger 158*c* has the same length as finger 158*a* so that wiper 154 is symmetrical as discussed above. The symmetry of wiper 154 allows wiper 154 to be attached to drive shaft 152 in either of two acceptable orientations providing ease of assembly. Otherwise, if wiper 154 is asymmetrical, a single orientation must be achieved when attaching each wiper 154 to each drive shaft 152 thereby increasing the possibility of assembly error.

Figure 11:
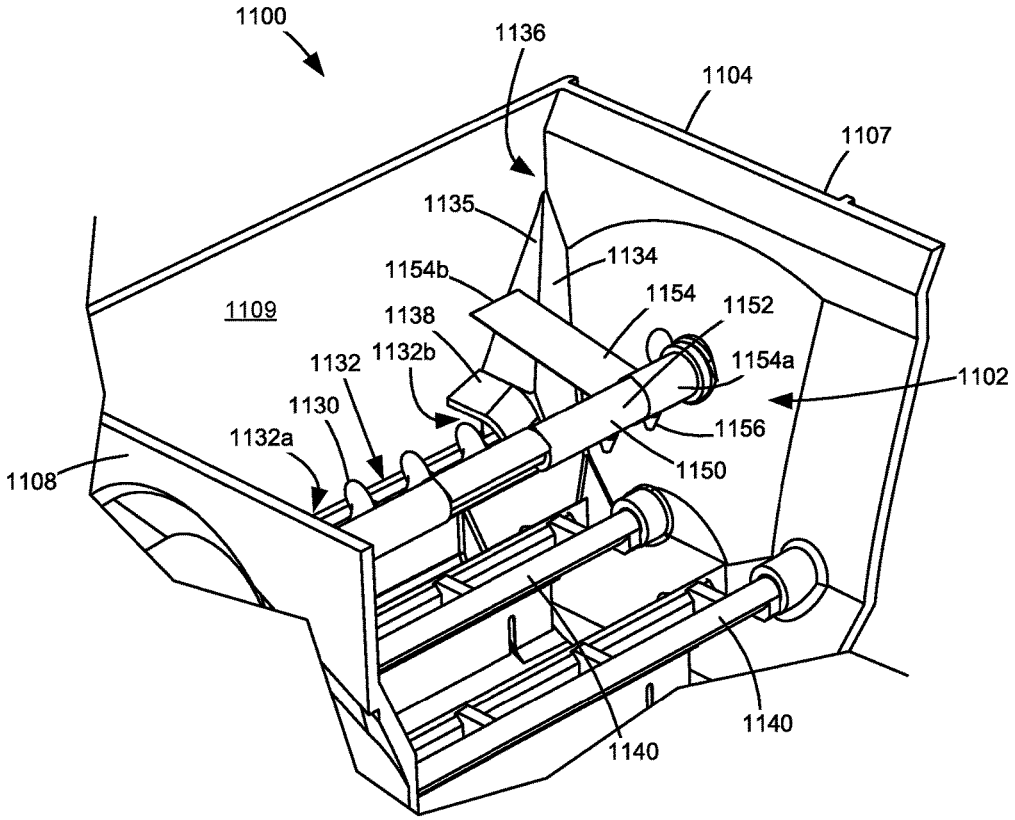
Figure 11 Prior Art
FIG. 11 is a cross-sectional view showing a toner agitator positioned within a toner reservoir of a prior art toner cartridge.

FIG. 11 shows a prior art toner cartridge 1100 having a toner reservoir 1102 formed by a housing 1104. Toner cartridge 1100 includes an auger 1130 positioned in a channel 1132 that runs along a side 1109 of housing 1104 from a front 1107 of housing 1104 to a rear 1108 of housing 1104. Channel 1132 includes an open portion 1132*a* and an enclosed portion 1132*b*. The rotation of auger 1130 delivers toner in channel 1132 to an outlet port (not shown) positioned in enclosed portion 1132*b* of channel 1132. Housing 1104 includes a pair of tapered walls 1134, 1135 positioned within toner reservoir 1102 at a corner 1136 formed at the intersection of front 1107 and side 1109 of housing 1104. Tapered walls 1134, 1135 are positioned directly above and lead downward to enclosed portion 1132*b* of channel 1132. Housing 1104 also includes a shelf 1138 formed at the top of enclosed portion 1132*b* of channel 1132 that extends from a bottom portion of tapered wall 1135 toward rear 1108 of housing 1104. Toner cartridge 1100 includes a toner agitator 1140 similar to toner agitator 140 discussed above that delivers toner to open portion 1132*a* of channel 1132 to supply auger 1130 with toner.

Toner cartridge 1100 also includes a toner agitator 1150 that extends outward from a rotatable drive shaft 1152. Toner agitator 1150 includes a wiper 1154 composed of PET material. Wiper 1154 includes a proximal end 1154*a* that is wrapped around drive shaft 1152 and retained on drive shaft 1152 by a mounting post 1156 that extends from drive shaft 1152 into a corresponding mounting hole on wiper 1154. Wiper 1154 also includes a distal end 1154. Wiper 1154 includes a single rectangular shaped sheet of PET material. Wiper 1154 primarily contacts tapered wall 1135 and shelf 1138 upon rotation of drive shaft 1152.

Wiper 154 of the present embodiment provides improved clearing of toner from corner 136 in comparison to prior art wiper 1154 because of the ability of fingers 158 to flex independently of each other to individually wipe the surfaces of tapered walls 134, 135 and shelf 138. This, in turn, helps reduce the amount of residual, unusable toner that accumulates in corner 136 of housing 104.

Although the example embodiment illustrated in FIGS. 5-10 includes a wiper 154 having two or more fingers 158 positioned in a toner reservoir 102 of a toner cartridge 100, it will be appreciated that a wiper, such as wiper 154, may be used in any toner reservoir where it is desired to clean or wipe toner from complex geometries. Further, although the example embodiment shown in FIG. 2 includes toner cartridges 100, developer units 200 and PC unit 300 positioned in separate replaceable units, it will be appreciated that the replaceable unit(s) of image forming device 20 may employ any suitable configuration as desired. For example, in one embodiment, the main toner supply for image forming device 20, developer unit 200 and PC unit 300 are combined in a separate replaceable unit for each color toner. In another embodiment, the main toner supply for image forming device 20 and developer unit 200 are provided in a first replaceable unit and PC unit 300 is provided in a second replaceable unit.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner agitator assembly, comprising:

a shaft rotatable about a rotational axis; and a wiper extending outward from the shaft and rotatable with the shaft; the wiper is composed of a flexible film material; the wiper includes a first finger, a second finger and a third finger formed in a distal end of the wiper relative to the shaft; the first, second and third fingers are individually deflectable counter to an operative rotational direction of the shaft; the wiper is symmetrical along a radial centerline of the wiper, wherein the first, second and third fingers each have the same width in a direction along the rotational axis of the shaft.

2. The toner agitator assembly of claim 1, wherein the first, second and third fingers extend in straight lines orthogonal to the rotational axis of the shaft.

3. The toner agitator assembly of claim 1, wherein the wiper includes a first slit through the film material separating the first and second fingers and a second slit through the film material separating the second and third fingers, the first and second slits extend from the distal end of the wiper toward a proximal end of the wiper relative to the shaft.

4. The toner agitator assembly of claim 3, wherein the first and second slits extend in straight lines orthogonal to the rotational axis of the shaft.

5. A toner agitator assembly, comprising:

a shaft rotatable about a rotational axis; and a wiper extending outward from the shaft and rotatable with the shaft; the wiper is composed of a flexible film material; the wiper includes a first finger, a second finger and a third finger formed in a distal end of the wiper relative to the shaft and extending orthogonal to the rotational axis of the shaft; the first, second and third fingers are individually deflectable counter to an operative rotational direction of the shaft; the first, second and third fingers each have the same width in a direction along the rotational axis of the shaft; the second finger is positioned between the first and third fingers; the second finger has a greater length than the first and third fingers.

6. The toner agitator assembly of claim 5, wherein the wiper is symmetrical along a radial centerline of the wiper.

7. The toner agitator assembly of claim 5, wherein the first and third fingers have the same length.

8. The toner agitator assembly of claim 5, wherein the wiper includes a first slit through the film material separating the first and second fingers and a second slit through the film material separating the second and third fingers, the first and second slits extend from the distal end of the wiper toward a proximal end of the wiper relative to the shaft.

9. The toner agitator assembly of claim 8, wherein the first and second slits extend in straight lines orthogonal to the rotational axis of the shaft.

10. A toner container, comprising:

a housing having a reservoir for storing toner;

adjoining first and second tapered walls positioned within the reservoir; the first tapered wall angles toward a first side of the housing as the first tapered wall extends downward toward a bottom of the housing; the second tapered wall angles toward a second side of the housing as the second tapered wall extends downward toward the bottom of the housing;

a rotatable shaft positioned within the reservoir and rotatable about a rotational axis; and a wiper extending outward from the rotatable shaft and rotatable with the rotatable shaft; the wiper is composed of a flexible film material; the wiper includes a first finger and a second finger formed in a distal end of the wiper relative to the rotatable shaft; the first and second fingers are individually deflectable counter to an operative rotational direction of the rotatable shaft; the first finger is positioned to contact the first tapered wall upon rotation of the rotatable shaft in the operative rotational direction and to deflect counter to the operative rotational direction of the rotatable shaft by the contact with the first tapered wall and the second finger is positioned to contact the second tapered wall upon rotation of the rotatable shaft in the operative rotational direction and to deflect counter to the operative rotational direction of the rotatable shaft by the contact with the second tapered wall.

11. The toner container of claim 10, wherein the first side of the housing is orthogonal to the second side of the housing.

12. The toner container of claim 10, wherein each of the first and second tapered walls consists of a planar surface.

13. The toner container of claim 10, further comprising a shelf positioned in the reservoir extending from a bottom portion of the second tapered wall, wherein the wiper includes a third finger that is formed in the distal end of the wiper and that is individually deflectable counter to the operative rotational direction of the rotatable shaft, the third finger is positioned to contact the shelf upon rotation of the rotatable shaft in the operative rotational direction and to deflect counter to the operative rotational direction of the rotatable shaft by the contact with the shelf.

14. A toner agitator assembly, comprising:

a shaft rotatable about a rotational axis; and a wiper extending outward from the shaft and rotatable with the shaft; the wiper is composed of a flexible film material; the wiper includes a first finger, a second finger and a third finger formed in a distal end of the wiper relative to the shaft; the first, second and third fingers are individually deflectable counter to an operative rotational direction of the shaft; the wiper is symmetrical along a radial centerline of the wiper, wherein the second finger is positioned between the first and third fingers and the second finger has a greater length than the first and third fingers.

15. The toner agitator assembly of claim 14, wherein the first and third fingers have the same length.

16. A toner agitator assembly, comprising:

a shaft rotatable about a rotational axis; and a wiper extending outward from the shaft and rotatable with the shaft; the wiper is composed of a flexible film material; the wiper includes a first finger, a second finger and a third finger formed in a distal end of the wiper relative to the shaft; the first, second and third fingers are individually deflectable counter to an operative rotational direction of the shaft, wherein the first, second and third fingers each have the same width in a direction along the rotational axis of the shaft.

17. A toner agitator assembly, comprising:

a shaft rotatable about a rotational axis; and a wiper extending outward from the shaft and rotatable with the shaft; the wiper is composed of a flexible film material; the wiper includes a first finger, a second finger and a third finger formed in a distal end of the wiper relative to the shaft; the first, second and third fingers are individually deflectable counter to an operative rotational direction of the shaft, wherein the second finger is positioned between the first and third fingers and the second finger has a greater length than the first and third fingers.

* * * * *